United States Patent [19]

Grimes et al.

[11] Patent Number: 4,989,481

[45] Date of Patent: Feb. 5, 1991

[54] AXLE RING REMOVAL TOOL

[75] Inventors: Benjamin F. Grimes; David L. McLane; Jim F. McGraw, all of Longview, Tex.

[73] Assignee: Stemco Inc., Longview, Tex.

[21] Appl. No.: 548,698

[22] Filed: Jul. 5, 1990

[51] Int. Cl.[5] ..... B25B 27/00

[52] U.S. Cl. ..... 81/488; 29/275; 81/463

[58] Field of Search ..... 81/488, 463, 10; 29/275, 282, 283, 283.5; 30/167

[56] References Cited

U.S. PATENT DOCUMENTS

| | | | |
|---|---|---|---|
| 2,910,771 | 11/1959 | Farmer | 30/167 |
| 3,103,064 | 9/1963 | Hankins | 29/283 |
| 3,166,757 | 1/1965 | Downs | 81/44 |
| 3,685,064 | 8/1972 | Cuscovitch, Sr. | 7/103 |

*Primary Examiner*—Roscoe V. Parker

*Attorney, Agent, or Firm*—Richard W. Watson

[57] ABSTRACT

A tool for use in stretching or elongating an axle ring so that it may be removed from an associated axle. A lever with an elongated nose impacts against a narrow band across the width of the axle ring and produces a peening or plastic flow action to elongate the ring. The tool includes means for locating itself on the axle to properly position the nose both axially and radially.

8 Claims, 3 Drawing Sheets

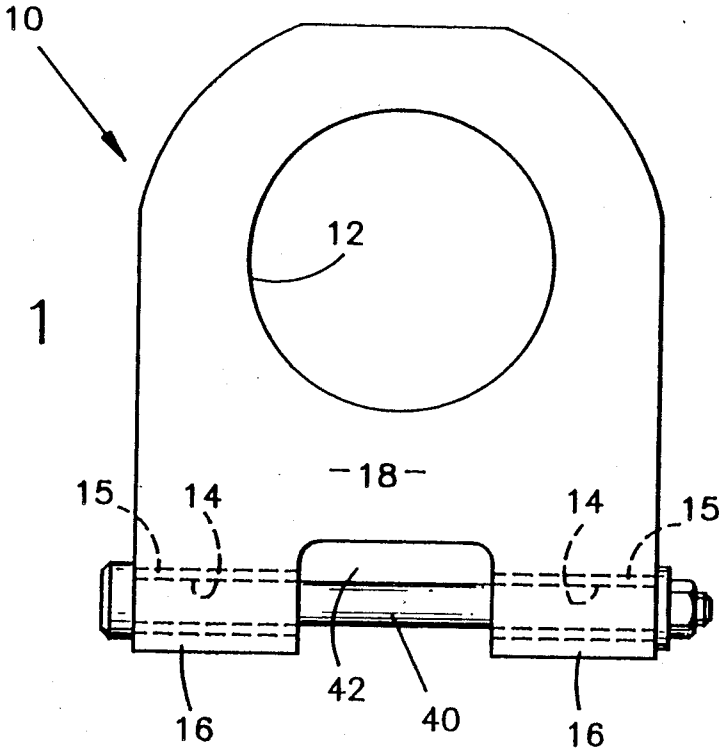
FIG. 1
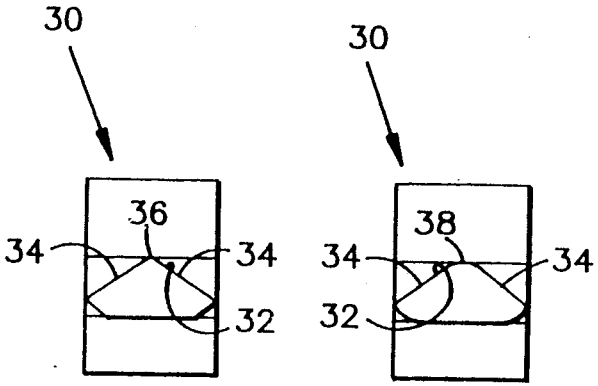
FIG. 3
FIG. 5
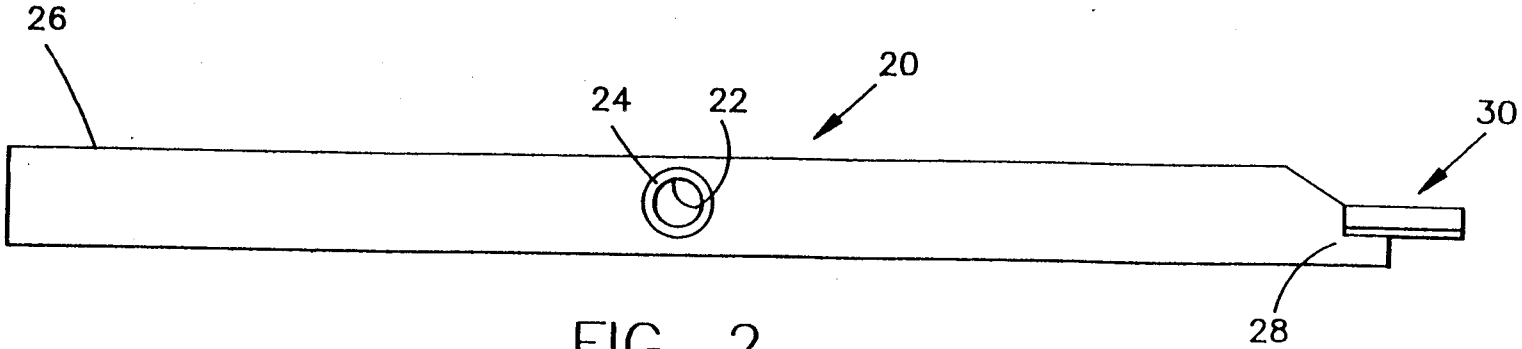
FIG. 2

AXLE RING REMOVAL TOOL

FIELD OF THE INVENTION

The invention relates to a tool which may be used to simplify the removal of axle rings from axles, especially when there is restricted radial space around the axle ring.

BACKGROUND OF THE INVENTION

In the operation of oil bath lip seals on tractor truck and tractor trailer axles, the sealing lips usually bear on an axle ring instead of directly on a portion of the axle or spindle. With such an arrangement, if excessive wear occurs, the axle ring may be replaced instead of rebuilding or replacing the whole axle. In this type of arrangement, the axle ring is normally sized to form a press fit on the axle or spindle. Thus, on a typical spindle with a diameter between 4.768 and 4.762 inches, the original I.D. of the axle ring would be in the range of 4.758 to 4.753 inches.

At present, when wear occurs to the extent that replacement of the axle ring is necessary, the worn ring is customarily peened with a ball peen hammer or with a hammer and a dull chisel or the like. The peening action stretches a portion of the axle ring until it slips easily off of the axle. However, this process does have some drawbacks. The spindle can be damaged if the peening action is too forceful or if the spindle is hit directly by the peen. Another major problem is that the axle ring is frequently inaccessible for conventional peening. Brake shoes, cylinders, backing plates or other parts mounted on or close to the axle in many cases make conventional peening impractical, if not impossible. In these situations and even though there is significant risk of damage to axles, axle rings are usually removed by cutting with a hammer and chisel or by prying with a special pry bar. Otherwise a major disassembly is required to gain access for peening. All of these alternatives are time consuming and costly.

SUMMARY OF THE INVENTION

In order to overcome these and other problems, the present invention provides a tool which utilizes a simple lever to transfer the necessary peening force to the axle ring. The tool includes means for locating and holding the lever in a proper position. Thus, a lever is pivotally connected to a pivot block Which includes an aperture which is used to locate the resulting tool assembly on a portion of an axle. When force is applied to one end of the lever, the opposite lever end reacts by applying a radial force to a portion of the axle ring thereby stretching it. Accordingly, it is a primary object of the invention to provide a simple and inexpensive tool to assist in stretching a press-fitted axle ring whereby the ring may be easily removed from its associated axle.

It is a further object to provide a tool which is easy to use and which minimizes any possibility of damage to the axle or any adjacent elements.

A still further object is to provide such a tool in an adjustable form whereby it may be used with a wider range of axle sizes.

BRIEF DESCRIPTION OF THE DRAWINGS

A fuller understanding of the present invention will be gained by reference to the following detailed description when read in conjunction with the attached drawings in which:

FIG. 1 is an end view of a pivot block,

FIG. 2 is a side view of a lever,

FIG. 3 is an enlarged end view of the lever of FIG. 2,

FIG. 5 is an enlarged end view of a lever having a modified nose portion.

DETAILED DESCRIPTION OF THE INVENTION

Figure 4:
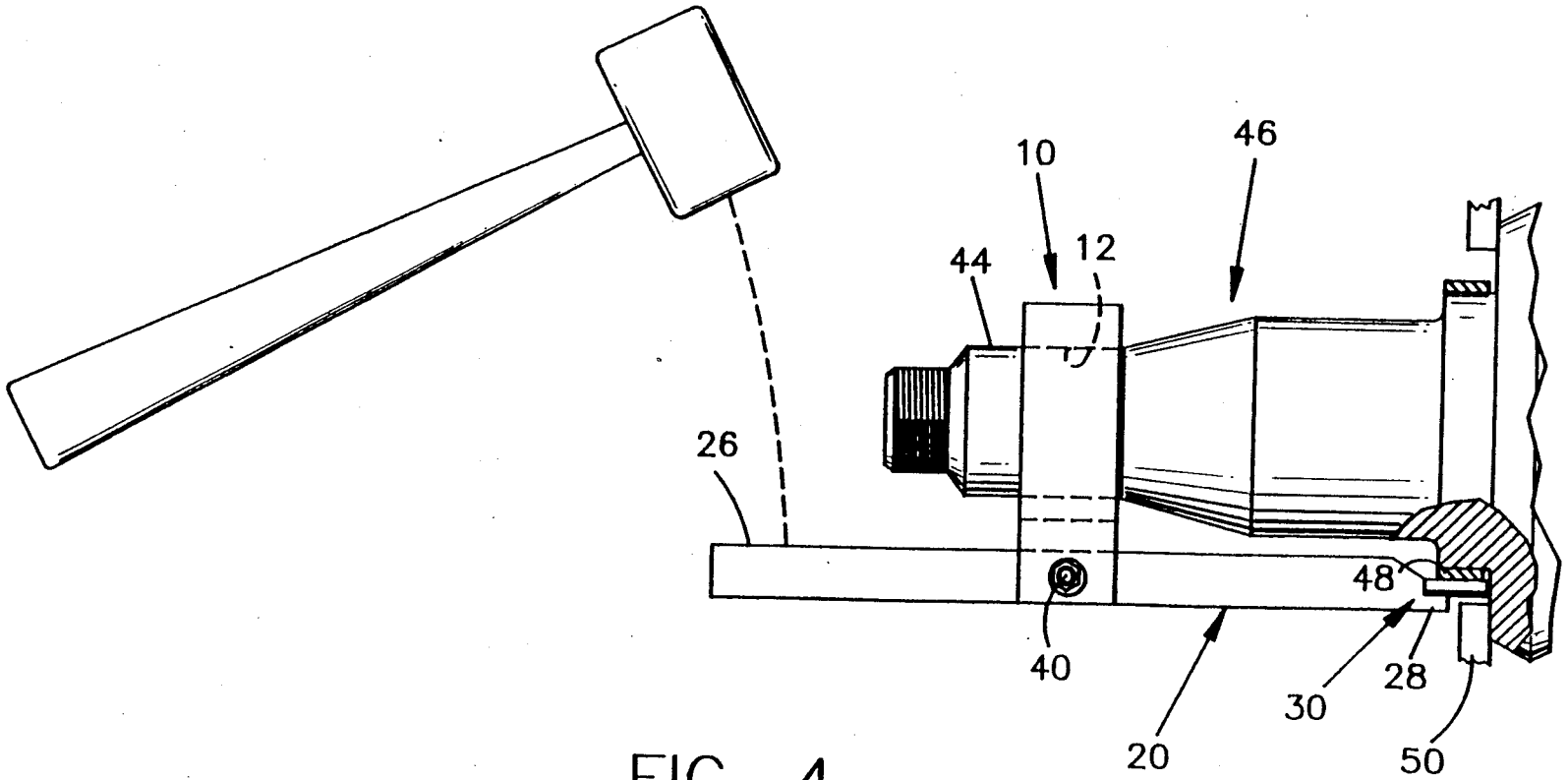
FIG. 4 is a side view, partially in section, of a tool assembled according to the invention and placed in operating position on an axially outer portion of an axle.

Referring now to the drawings, FIG. 1 shows a pivot block 10 having an annular aperture 12 and a yoke portion 18. Aperture 12 is dimensioned to form a slip fit with an axially outer portion of an axle or spindle from which an axle ring is to be removed. Preferably the slip fit will be on the outer bearing journal of the axle or spindle. A bushing 15 having a pivot pin opening 14 is pressed into a suitable bore in each leg 16 of yoke portion 18 of pivot block 10. Pivot pin openings 14 are dimensioned to receive a pivot pin 40 as will be described later. FIG. 2 illustrates a lever 20 having an annular opening 22 in a bushing 24 pressed into a suitable bore in the side of lever 20. Lever 20 also has a force receiving end 26 and a force transmitting end 28 having a nose portion 30. As may be seen in FIG. 3, nose portion 30 has a face 32 comprising a pair of planar surfaces 34 which meet at a line 36 which line is parallel to the longitudinal axis of lever 20.

Pivot block 10 and lever 20 are assembled as shown in FIG. 4 to form the axle ring removal tool of the invention. Joining of these two elements is accomplished by means of pivot pin 40 which passes through openings 14 in both bushings 15 and through opening 22 in bushing 24. Thus, lever 20 is held in slot 42 (see FIG. 1) of pivot block 10. While pivot pin 40 is shown in FIG. 1 as a shoulder bolt and nut, any of several other forms may be used. Thus, pin 40 could be pressed into openings 14 or it could be slipped through one of the openings 14 and threaded into the other such opening. The essential feature is that lever 20 be able to pivot at least slightly in slot 42. Further, while the inclusion of bushings such as 15 and 24 is preferred, they are not necessary.

To use the tool to remove an axle ring in a preferred manner, pivot block 10 is located on outer journal bearing 44 of axle 46 with a slip fit through aperture 12. This properly positions the lever bar 20 and also locates the nose 30 substantially parallel to axle 46 so that line 36 of face 32 can make maximum contact with the axle ring to be removed. Ideally, the line of contact extends completely across the width of the axle ring. Once the tool is placed in proper position, a force is applied to the force receiving end 26 with a sharp downward blow as with a hammer as shown in FIG. 4. By means of the lever, the force is transferred via force transmitting end 28 in an upward direction to axle ring 48. After one or two blows in this position, the tool may be rotated around the axle through approximately 10° and one or two further blows applied to end 26. If necessary, the process may be repeated again. Usually, a total of from two to four hammer blows are sufficient to stretch an axle ring enough to slip it off of the spindle. Brake backing plate 50 is shown to illustrate how other elements may be positioned to make it difficult, if not impossible, to stretch an axle ring with prior methods and tools. Sometimes a bearing spacer is pressed onto the spindle and the axle ring is pressed onto the spacer. However, this will have no effect on the tool of the present invention and its use except that the fulcrum of the lever must be lengthened by the radial thickness of the bearing spacer.

In FIG. 5 there is illustrated a slightly modified lever arm nose portion 30. In this embodiment, the planar surfaces 34 and line 36 of face 32 of FIG. 3 are replaced by partially convex surface 38 and the lower surface of nose 30 is rounded rather than chamfered. Other shapes, such as parabolic, may be used as long as when force is applied to lever 20, nose portion 30 contacts an axle ring along a narrow band substantially parallel to the axle axis.

While the pivot block is preferably located axially on the outer bearing journal, it may be located otherwise by selecting a diameter of aperture 12 to fit any desired portion of axle 42. The essential features are that wherever aperture 12 is located relative to the axle, the nose 30 of lever 20 should be substantially parallel to the axis of the axle and when force is applied to the end 26 of lever 20, nose 30 should be in maximum linear contact with the axle ring which is to be removed.

Up to this time, we have described a tool with a pivot block aperture of fixed dimension and a pivot pin being in fixed location relative to the other parts of the tool and the axle ring to be removed. Such a tool will be most desirable for those users having a substantially uniform fleet of vehicles. As long as the locating portion of the axles and the diameter of the axle rings are the same from one vehicle to another, the same tool may be used. However, there will be occasions where a tool having adjustable features may be desired. For instance, if a fleet has a variety of vehicles with differing axles and axle rings, having an adjustable tool which would accommodate different axle diameters and lengths and which would also be useful in removing axle rings of differing diameters would obviate the necessity of having a separate tool to accommodate each different set of dimensions.

Figure 6:
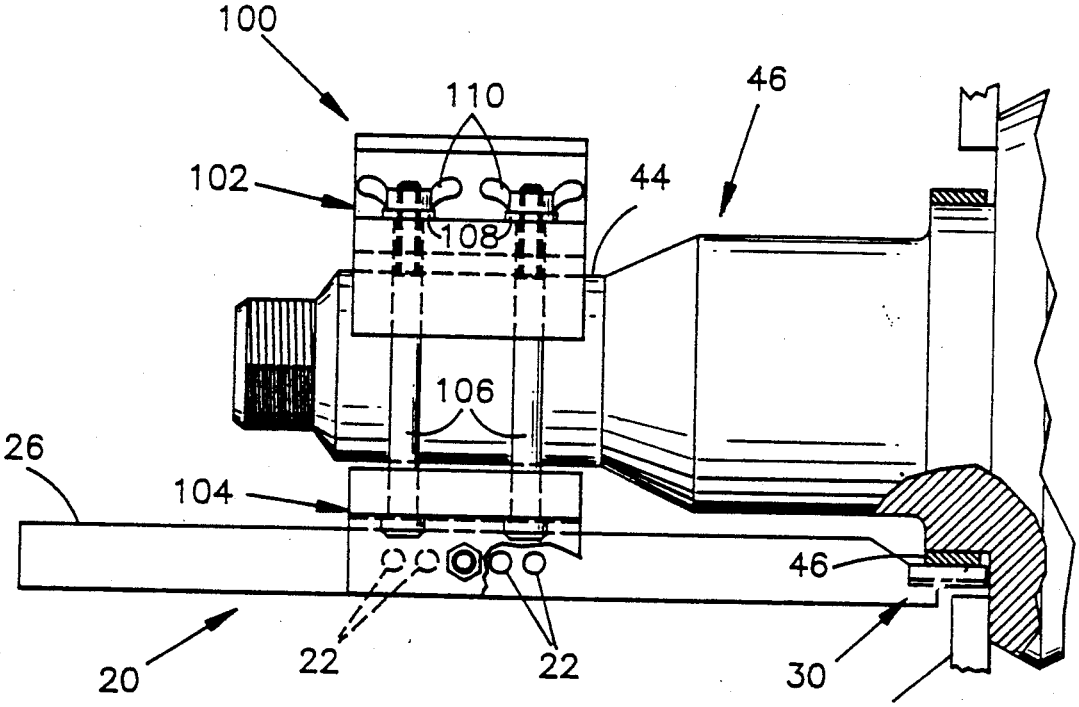
FIG. 6 is a side view, partially in section and partially cutaway, of an adjustable embodiment of the invention located in operating position on an axially outer portion of an axle.
Figure 7:
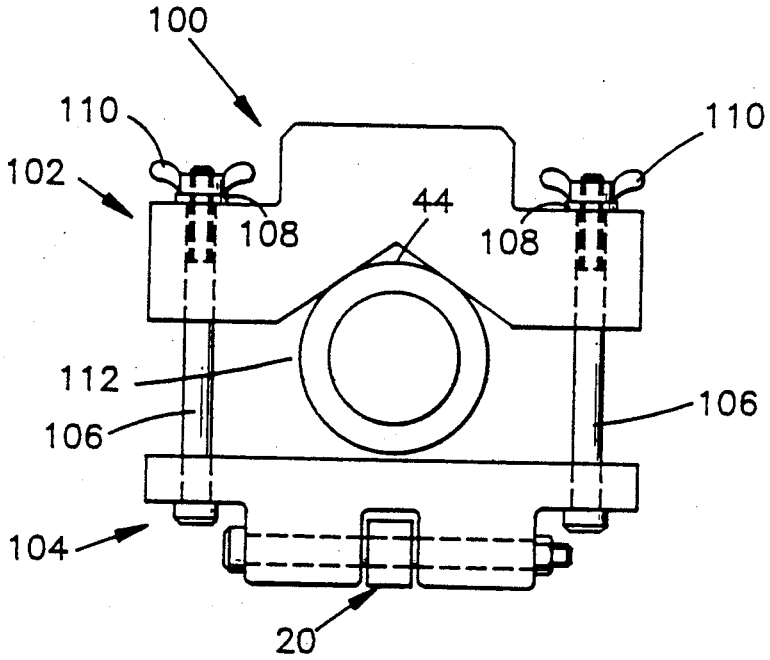
FIG. 7 is an end view of the embodiment of FIG. 6.

Accordingly, FIGS. 6 and 7 illustrate an axle ring removal tool which has adjustable features and which may be used with a relatively wider variety of axles and axle rings. Thus, pivot block 100 is an assembly of parts comprising an upper portion 102 and a lower portion 104 assembled together in a desired relative position and held by a plurality of adjustable fasteners such as shoulder bolts 106 with washers 108 and wing nuts 110. Upper and lower portions, 102 and 104 respectively, define between them an aperture 112 large enough to allow a slip fit of pivot block 100 on desired portion 44 of an axle 46. If the tool is to be used on a somewhat smaller diameter axle, tightening of wing nuts 110 will bring portions 102 and 104 closer together and reduce the size of aperture 112. In the same manner, larger axles may be accommodated by loosening wing nuts 110. As with the embodiment illustrated in FIG. 4, the essential requirement is to raise and lower the pivot point so that the nose 30 of lever 20 makes maximum contact with the axle ring when force is applied to the end 26 of lever 20.

It is also possible to vary the distance between the pivot point and the nose 30 of lever 20. Thus, in the lever 20 of FIG. 6, there are five openings 22. All that is necessary is for the user to select that one of the five openings which positions nose 30 so that it will contact axle ring 46 across substantially its entire width.

Whichever design tool is used, the force transmitted to the axle ring is sufficiently concentrated to exceed the elastic limit of the material of the axle ring. This causes slight plastic flow of the material of the axle ring, thereby bringing about its circumferential elongation.

While preferred embodiments of the invention have been shown and described in detail, other modifications will be readily apparent to those skilled in the mechanical arts. For example, while in most instances it will be preferred to locate lever 20 substantially parallel to axle 46, there may be instances where it is desired to have the main body of lever 20 at an angle to the axle. In such a situation, it would only be necessary to modify the lever by offsetting the nose portion 30 so that it maintains maximum contact with axle ring 48 when force is applied to the force receiving end 26 of the lever. Thus, the preceding specification should be interpreted as exemplary rather than as limiting and the scope of the invention as defined by the following claims.

We claim:

1. An axle ring removal tool comprising:

(a) a pivot block having an aperture at least large enough to form a slip fit on a portion of an axle from which an axle ring is to be removed and at least one pivot pin opening and (b) a lever having at least one pivot pin opening and being pivotally connected to said pivot block by means of a pivot pin extending through at least one pivot pin opening in each of said pivot block and said lever and also having a force receiving end and a force transmitting end, said force transmitting end including a nose portion having a face adapted to contact an axle ring to be removed along a narrow band substantially parallel to the axis of said axle ring when force is applied to said force receiving end.

2. The tool of claim 1, wherein said face of said nose portion comprises a pair of planar surfaces meeting at a line substantially parallel to the axis of the axle ring to be removed.

3. The tool of claim 1, wherein at least a portion of said face is convex.

4. The tool of claim 1 wherein said aperture is annular and said pivot block is unitary.

5. The tool of claim 1 wherein said lever includes a plurality of pivot pin openings adapted to permit adjustment of the length of the force transmitting end of said lever.

6. The tool of claim 1 wherein said nose portion contacts said axle ring across substantially its entire width when said force is applied.

7. The tool of claim 1, wherein said pivot block comprises upper and lower portions which define said aperture between them and means for adjusting the spacing between said portions.

8. The tool of claim 6 wherein said lever includes a plurality of pivot pin openings adapted to permit adjustment of the length of the force transmitting end of said lever.

* * * * *